US007513326B2

(12) United States Patent
Miyachi

(10) Patent No.: US 7,513,326 B2
(45) Date of Patent: Apr. 7, 2009

(54) WORKING MACHINE

(75) Inventor: Isao Miyachi, Hiroshima (JP)

(73) Assignee: Kobelco Construction Machinery Co., Ltd., Hiroshima-shi (JP)

( * ) Notice: Subject to any disclaimer, the term of this patent is extended or adjusted under 35 U.S.C. 154(b) by 149 days.

(21) Appl. No.: 10/806,396

(22) Filed: Mar. 23, 2004

(65) Prior Publication Data

US 2004/0188157 A1 Sep. 30, 2004

(30) Foreign Application Priority Data

Mar. 28, 2003 (JP) ..... 2003-091583

(51) Int. Cl.
*B62D 33/067* (2006.01)

(52) U.S. Cl. ..... 180/68.4; 180/68.6; 180/69.2; 180/326; 180/327; 180/9; 180/68.2; 180/68.3

(58) Field of Classification Search ..... 180/326, 180/327, 68.6, 69.2, 68.2, 68.3, 68.4, 9
See application file for complete search history.

(56) References Cited

U.S. PATENT DOCUMENTS 3,444,945 A * 5/1969 Coordes et al. ..... 180/19.3
3,788,418 A * 1/1974 Clancy et al. ..... 180/68.4
3,814,531 A * 6/1974 Camahan et al. ..... 404/117
4,040,501 A * 8/1977 Haswell ..... 180/89.18
4,135,592 A * 1/1979 Wincent ..... 180/19.2
4,280,785 A * 7/1981 Albrecht ..... 414/735
4,721,213 A * 1/1988 Eitel ..... 212/285
5,156,664 A * 10/1992 Maltby et al. ..... 65/182.2
5,199,521 A * 4/1993 Samejima et al. ..... 180/68.1
5,671,820 A * 9/1997 Kobayashi et al. ..... 180/68.1
6,072,443 A * 6/2000 Nasserbakht et al. ..... 345/7
6,427,798 B1 * 8/2002 Imashige ..... 180/309
6,729,831 B1 * 5/2004 Kawamura et al. ..... 414/694
6,922,925 B2 * 8/2005 Watanabe et al. ..... 37/466
2004/0188157 A1 9/2004 Miyachi

FOREIGN PATENT DOCUMENTS

JP 6-207419 7/1994
JP 8-246503 9/1996

(Continued)

OTHER PUBLICATIONS

U.S. Appl. No. 11/678,802, filed Feb. 26, 2007, Taniuchi et al.

*Primary Examiner*—Chris Ellis
*Assistant Examiner*—Cynthia F. Collado
(74) *Attorney, Agent, or Firm*—Oblon, Spivak, McClelland, Maier & Neustadt, P.C.

(57) ABSTRACT

A working machine is constituted so as to mount a guard cover hinge, a radiator duct, a canopy right support, a hood catch and the right end part of a seat stand on a radiator support. The working machine further comprises a mounting column provided on the opposite side of the radiator support so as to mount a hood hinge, a left side panel, the left end part of the seat stand and a muffler cover thereon. According to such a structure, a mounting member shared by a plurality of constituting members can be used also as a positioning support between members, and the workability in assembling can be improved.

11 Claims, 5 Drawing Sheets

FOREIGN PATENT DOCUMENTS

| | | |
|---|---|---|
| JP | 9-193671 | 7/1997 |
| JP | 9-316929 | 12/1997 |
| JP | 10-292428 | 11/1998 |
| JP | 10-331195 | 12/1998 |
| JP | 2002-13157 | 1/2002 |
| JP | 2002-146834 | 5/2002 |
| JP | 2003-003519 | 1/2003 |

* cited by examiner

WORKING MACHINE

BACKGROUND OF THE INVENTION

1. Field of the Invention

The present invention relates to a working machine such as hydraulic excavator.

2. Description of the Related Art

In a hydraulic excavator, a mounting member for mounting equipment of every kind including an engine as a constituting member (member) on the frame of an upper rotating body is shared by members. In Japanese Patent Application Laid-Open (Kokai) No. 10-331195, for example, a canopy support, a radiator and an engine cover are mounted on a support member arranged across the engine.

In a structure disclosed in Japanese Patent Application Laid-Open No. 9-193671, for example, a duct for cooling air passed through a radiator is mounted on the mounting member of the radiator.

In both the case, however, the total number of part items is merely reduced by sharing one mounting member by a plurality of members to reduce the number of mounting members themselves. Namely, the positional management between members that is the most important and troublesome in an assembling work of equipment is still required for each of the members as before. Therefore, the problem that the assembling property of equipment cannot be improved remains.

SUMMARY OF THE INVENTION

The present invention thus has an object to provide a working machine capable of improving the assembling property of multiple pieces of equipment or devices.

The working machine of the present invention is characterized in that a mounting member shared by multiple pieces of equipment as elements is used also as a positioning support between those elements.

This working machine has the following basic structure.

Namely, the working machine comprises an upper rotating body with an upper frame rotatably mounted on a lower traveling body, devices including an engine and a radiator as well as an accessory mounted on the upper frame, covers for covering the devices and the accessory, and a mounting member for mounting two elements selected from a group consisting of the devices, the accessory and the covers thereon. The mounting member has a positioning supports adapted to arrange the two elements in a predetermined position of the mounting member.

A structure in which one of the devices and the accessory in addition to the covers are mounted on the mounting member can be adapted.

This mounting member includes a radiator mounting member and a mounting column, and either one of them or the both can be equipped as the mounting member with the working machine.

In this case, the mounting member can be shared by a plurality of the elements, and the mounting member further can be used also as a positioning support between those elements. Therefore, the positional relation between the elements can be automatically and precisely kept only by mounting a plurality of the elements on the common mounting member. Consequently, the efficiency in the assembling work of each element and thus in the assembling work of the upper rotating body can be significantly improved.

DESCRIPTION OF THE PREFERRED EMBODIMENTS

A working machine according to one embodiment of the present invention will be described in reference to FIGS. 1-4.

Figure 5:
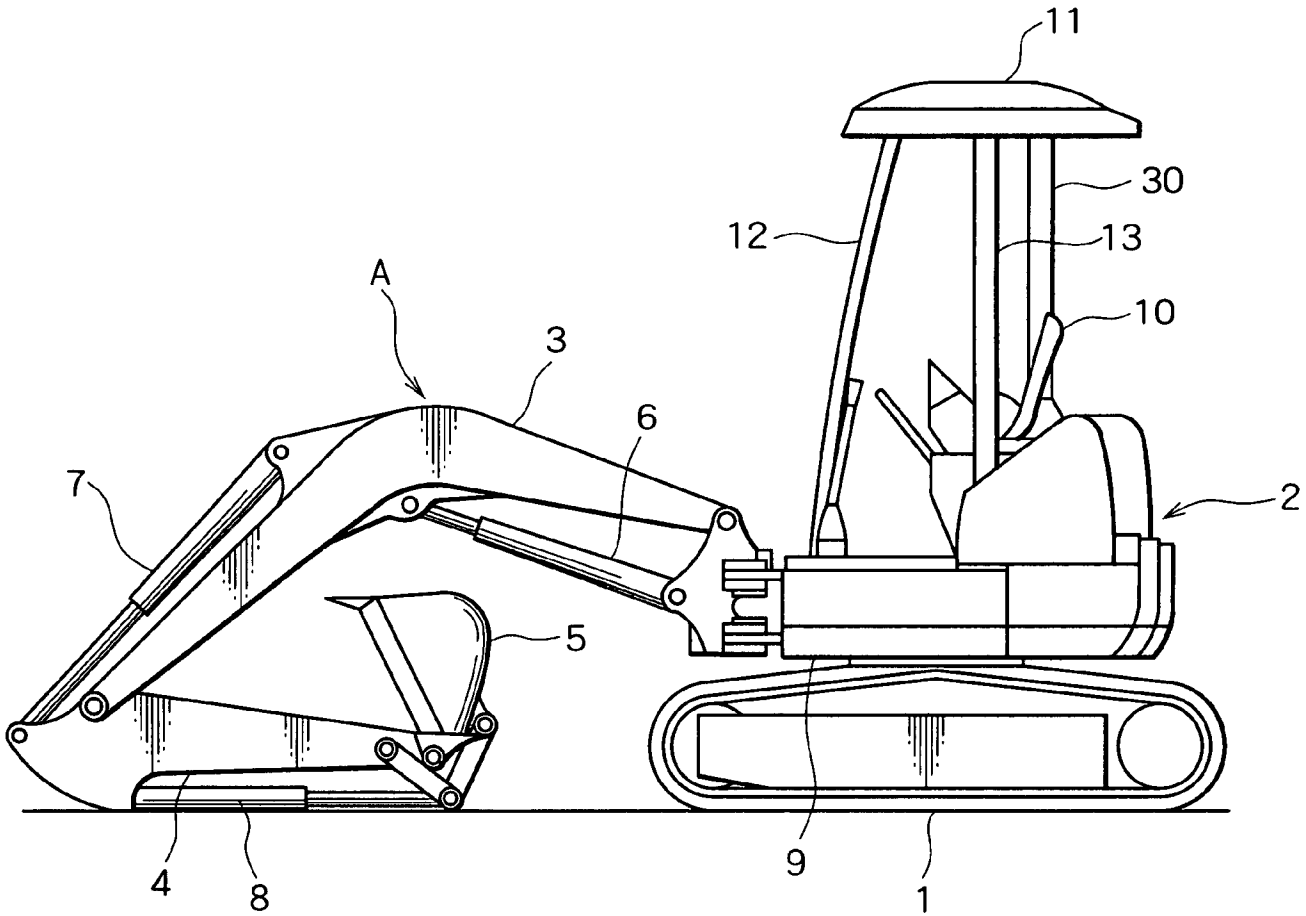
FIG. 5 is a schematic side view of a hydraulic excavator to which the present invention is applied.

A hydraulic excavator is described as an example of the working machine to which the present invention is applied. FIG. 5 shows a small hydraulic excavator called compact excavator. In this hydraulic excavator, an upper rotating body 2 is mounted on a crawler type lower traveling body 1 so as to be rotatably around a vertical axis. The upper rotating body 2 is equipped with a working device "A" comprising a boom 3, an arm 4, and a bucket 5 as working attachment, and cylinders 6, 7 and 8 for driving the boom, arm and bucket, respectively.

The upper rotating body 2 comprises a number of elements provided on an upper frame 9 as base plate, such as equipment of every kind such as engine, radiator or interior equipment, covers (exterior body) for covering them, an operator's seat 10, and a canopy 11 for covering the operator's seat 10 from above. Denoted at 12 is a canopy front support for supporting the canopy 11, 13 is a canopy left support, and 30 is a canopy right support.

Figure 1:
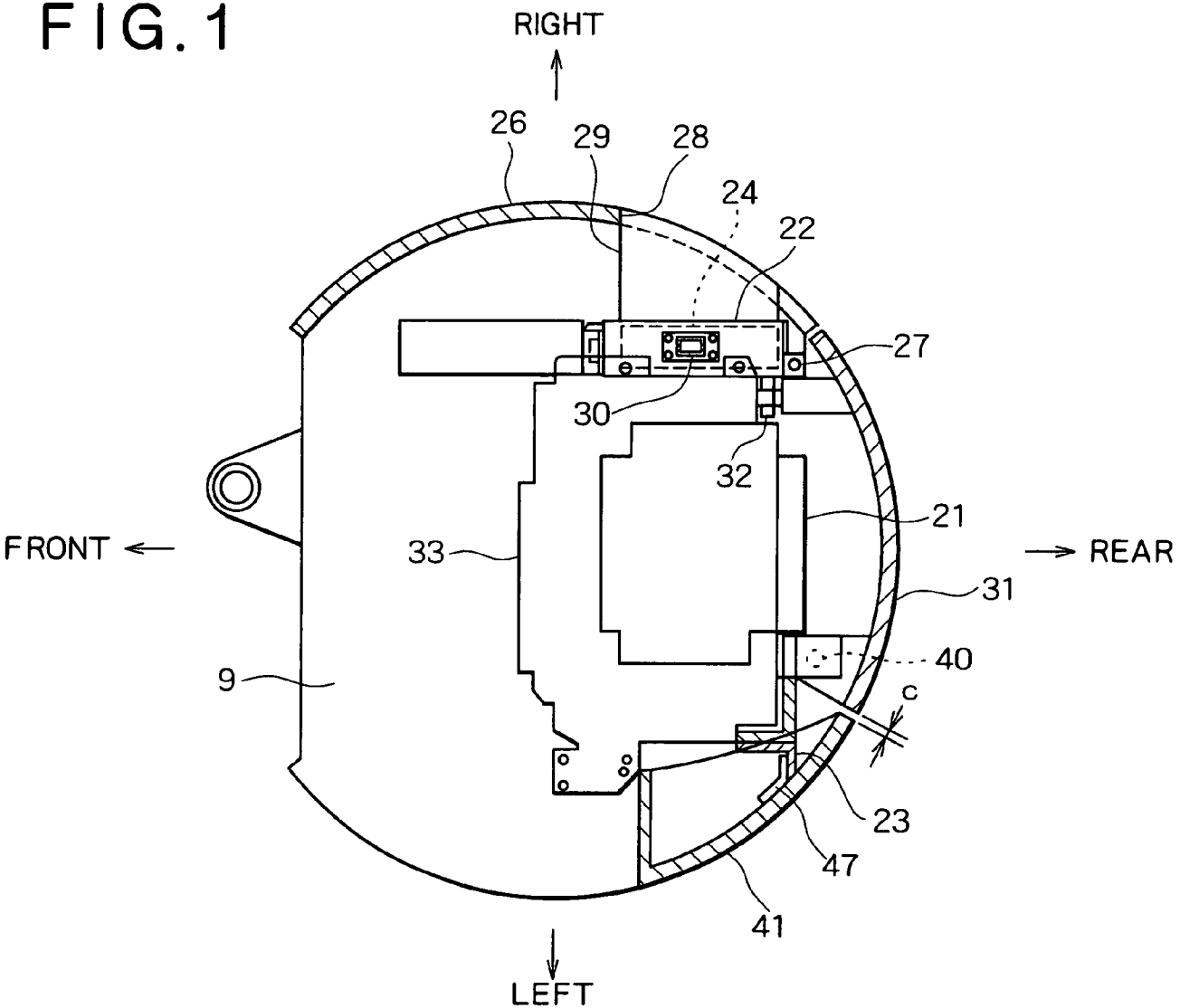
FIG. 1 is a schematic horizontal sectional view of the upper rotating body of a hydraulic excavator according to one preferred embodiment of the present invention.
Figure 2:
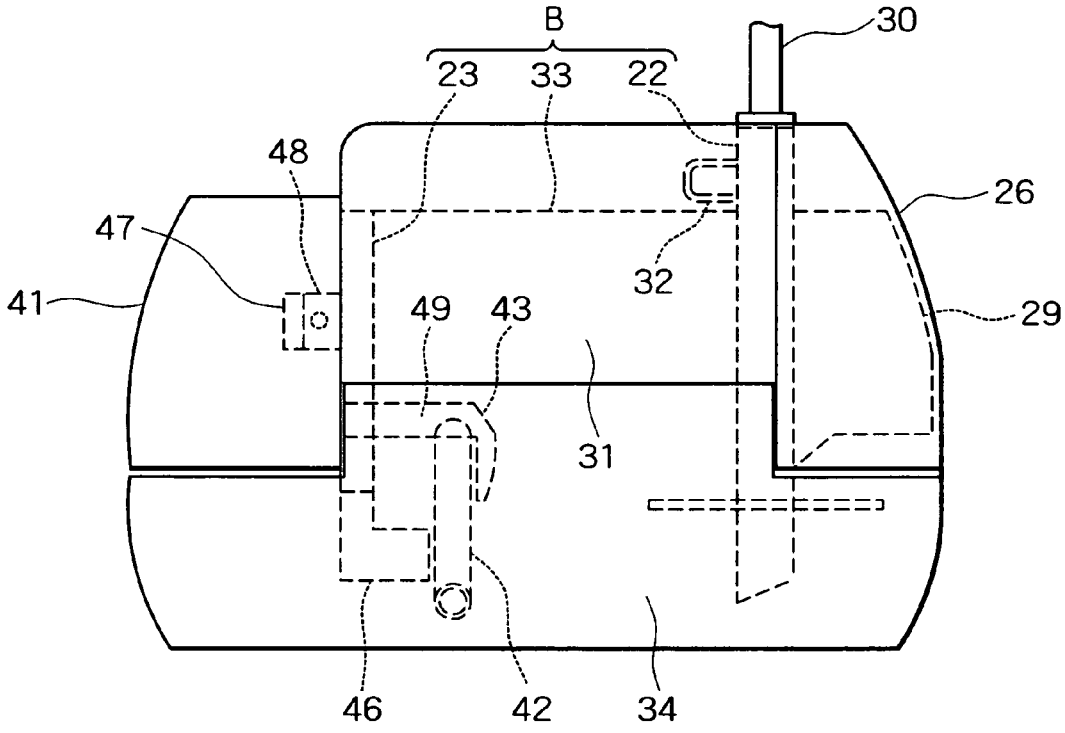
FIG. 2 is a back view of the same.

As shown in FIG. 1 and 2, as the mounting member shared by a plurality of elements at the rear part of the upper frame 9, a radiator support 22 as a radiator mounting member and a mounting column 23 are provided on the right side (the upper side of FIG. 1) and left side of an engine 21, respectively. The radiator support 22 supports a radiator 24. The radiator support 22 is provided on one lateral side at the rear part of the upper frame 9, while the mounting column 23 is provided on the other (opposite) side.

The radiator support 22 and/or the mounting column 23 are used also as positioning supports between elements.

A radiator duct 29, a canopy support (e.g., a right support 30), and a muffler cover or silencer cover 43 which are described later are included in the accessory.

A guard cover 26, a side panel (e.g., a left panel 41), and a hood or bonnet 31 are included in the covers for covering the devices and the accessory.

A hood catch or bonnet catch 32, a hood hinge or bonnet hinge 40, a guard cover hinge 27, and a seat stand 33 are included in the positioning supports.

The elements to be mounted on the radiator support 22 and mounting column 23 and the mounting structure thereof are as follows.

(i) Radiator Support

Figure 3:
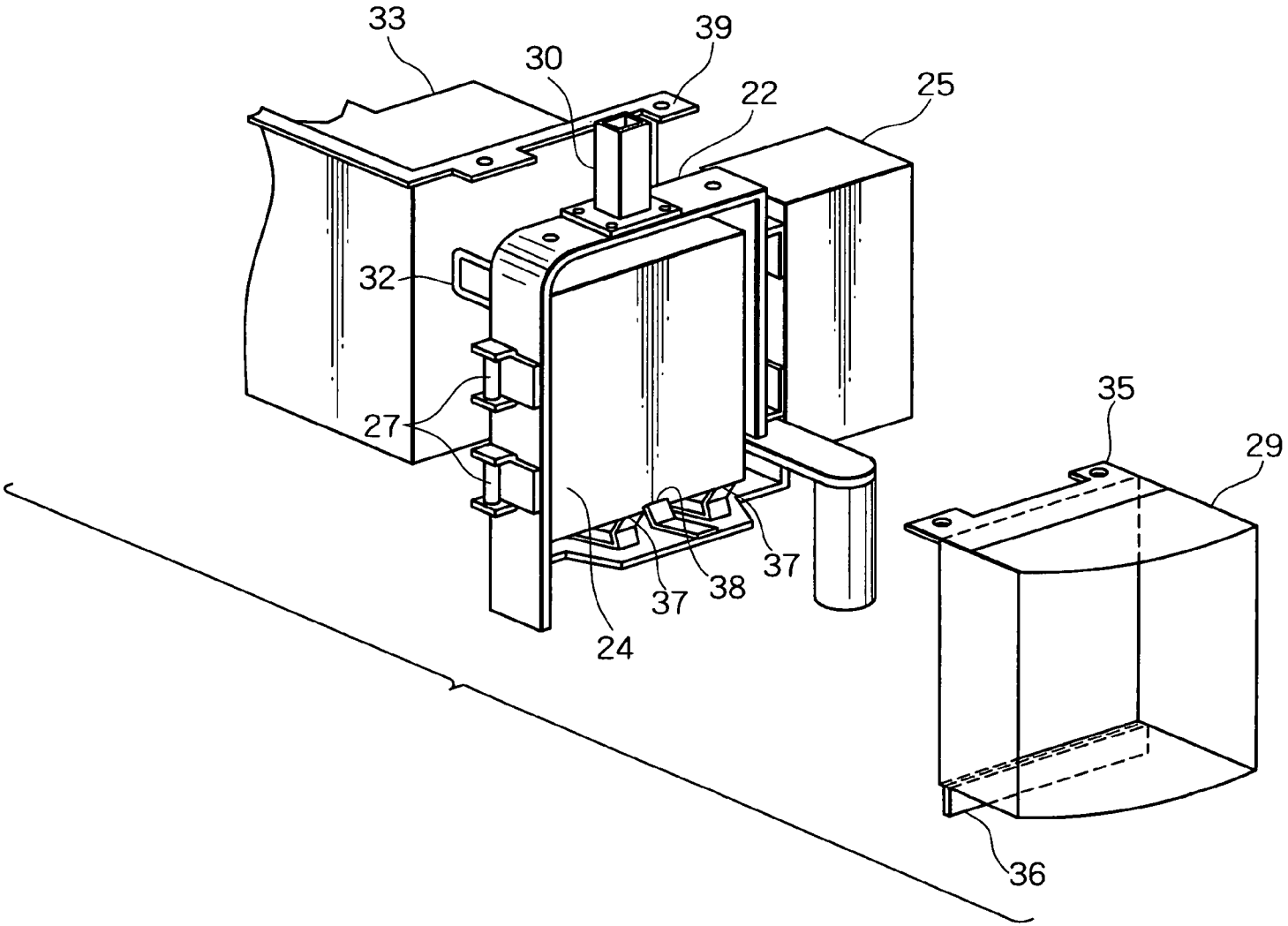
FIG. 3 is a perspective view showing the mounting state of each element around a radiator support in the same embodiment.

As shown in FIGS. 1-3, the radiator 24, a hydraulic oil tank 25, guard cover hinges 27 and 27, a radiator duct 29, the canopy right support 30, the catch 32 for closing a bonnet 31, and the seat stand 33 are mounted on the radiator support 22. The radiator duct 29 is detachably mounted on the support 22.

In FIG. 1, only the lower end portion of the canopy right support 30 is shown for the sake of convenience.

The hinges 27, 27 for openably and closably supporting the right guard cover 26 as exterior body serves as fulcrums on opening and closing the guard cover 26. Namely, the guard cover 26 is openable around the hinge 27 as fulcrum on opening and closing. Therefore, the guard cover 26 is openably and closably supported so as to cover equipment of every kind such as the engine or radiator from one side (the right side). A guard cover catch for fixing the guard cover in a closed state is separately provided although it is not shown.

The radiator duct 29 is cylindrically formed, and has the function of guiding cooling air between the radiator 24 and the airport (air inlet or outlet) 28 of the guard cover 26. The canopy right support 30 supports the canopy 11 of FIG. 5 on the rear right side. The catch 32 for closing the bonnet 31 is openably and closably provided on the back side of the engine mainly for the maintenance of the engine 21. The operator's seat 10 of FIG. 5 and a control lever are arranged on the seat stand 33. In FIG. 2, denoted at 34 is a counterweight.

The radiator support 22 is formed in a substantially square frame shape as shown in FIG. 3. The radiator support 22 mount the guard cover hinges 27, 27 on its rear surface, the hydraulic oil tank 25 on its front surface, and the lower end of the canopy right support 30 on its upper surface, respectively.

The radiator duct 29 has a horizontal mount 35 on the upper side of the radiator 24-side opening edge and a downward engaging portion 36 on the lower side. The engaging portion 36 is inserted and engaged between a longitudinal pair of first protruding pieces 37, 37 provided upward on the bottom wall of the radiator support 22 and a second protruding piece 38. The second protruding piece 38 is provided between the first protruding pieces 37 and 37 with a lateral slippage to the protruding pieces 37 and 37.

The mount 35 is fixed to the upper surface of the radiator support 22 by a bolt or screw not shown in this state, whereby the mounting of the radiator duct 29 on the radiator support 22 is completed.

When adapting a side-by-side system where an oil cooler is arranged side-by-side with the radiator 24, the radiator duct 29 servers a duct common to them.

The seat stand 33 has a horizontally protruding right mounting portion 39 on the upper right side (FIG. 3). The right mounting portion 39 is fixed to the upper surface of the radiator support 22 by a bolt or screw not shown, whereby the mounting of the seat stand 33 on the radiator support 22 is completed.

According to this structure, the following effects can be obtained.

1) The radiator support 22 can be used also as the mounting and positioning support for the guard cover hinges 27 and 27 and the radiator duct 29. Therefore, the management of the space between the radiator 24 and the airport (an air inlet in suction type or an air outlet in discharge type) is facilitated.

2) In the structure having the canopy, the support 22 can be used also as the mounting and positioning members for the guard cover hinges 27, 27 and the canopy right support 30. Therefore, the position management of the canopy right support 30 and an opening (hole or cutout) (not shown) for passing the support 30 through, which is provided on the guard cover 26, is facilitated.

ii) Mounting Column

Figure 4:
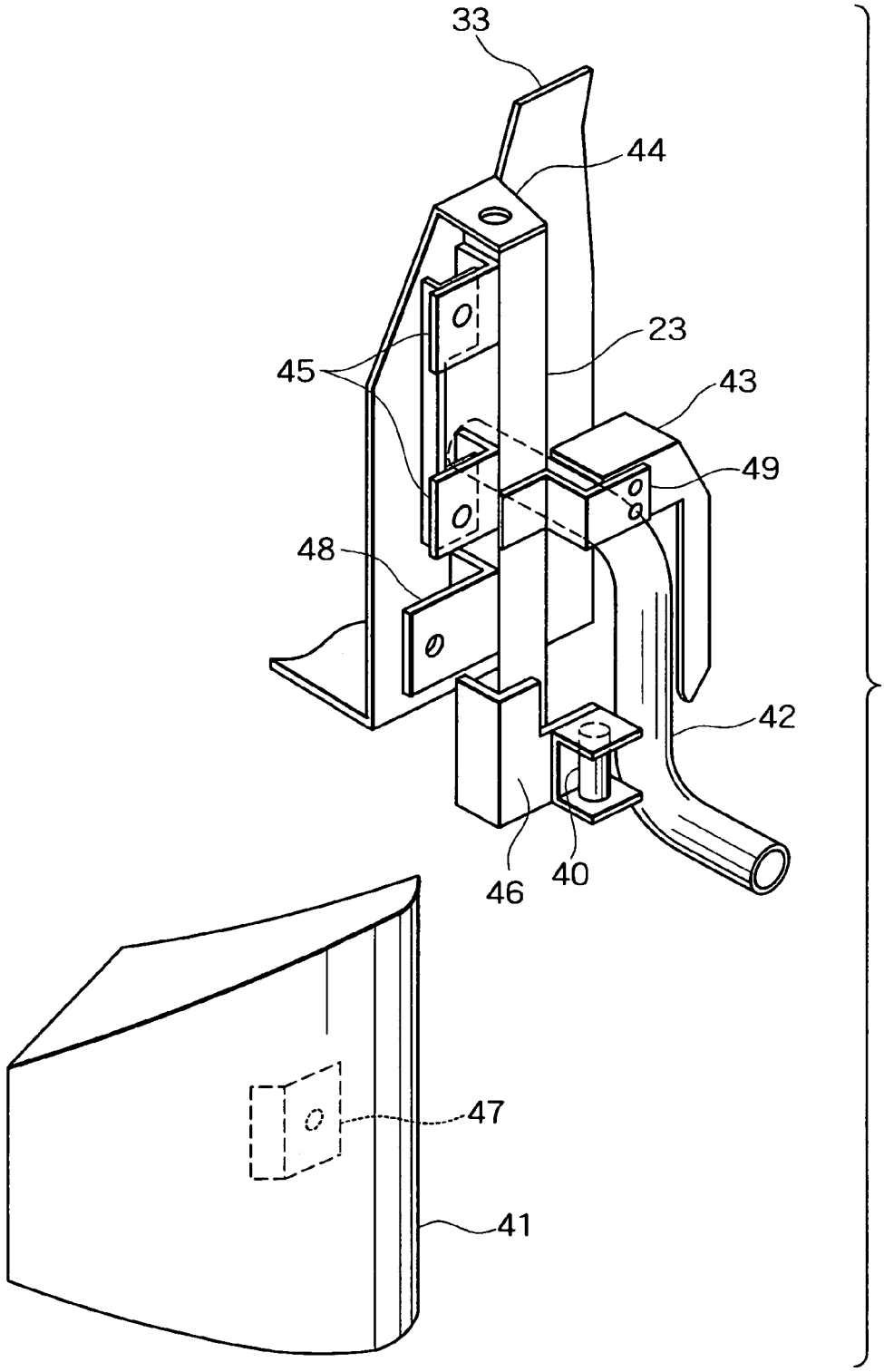
FIG. 4 is a perspective view showing the mounting state of each element around a mounting column in the same embodiment.

The mounting column 23 as a mounting member is formed in an angle shape (angle-shape sectional shape, L-shaped sectional shape, etc.). As shown in FIGS. 1, 2 and 4, the left rear portion of the seat stand 33, the bonnet hinge 40, the left panel 41 as a side panel, and the muffler cover 43 are mounted on the column 23. The bonnet hinge 40 serves as fulcrum on opening and closing bonnet 31. The bonnet 31 is openably mounted on the mounting column 23 through the hinge 40 to be adapted to cover the back side of the engine. The left panel 41 is arranged adjacently to the left side of the bonnet 31. The muffler cover 43 is arranged in the vicinity of the bonnet 31 to cover the muffler 42 for engine exhaust.

The seat stand 33 is provided with, as shown in FIG. 4, a backward mounting bracket 44 and a mounting bracket 45 on the left upper end part. The bracket 45 extends left, the mounting bracket 44 and the mounting bracket 45 are bolted to the upper end and left side surface of the mounting column 23, respectively.

The shape of the mounting column 23 is not limited to the angle shape as long as it can function as the mounting member as described above.

The bonnet hinge 40 is mounted on a hinge mounting portion 46 provided on the lower end part of the mounting column 23.

The left panel 41 has a mounting portion 47 inside the panel 41. The panel 41 is fixed to the mounting column 23 by connecting the mounting portion 47 to a panel mounting bracket 48.

The muffler cover 43 is mounted on the mounting column 23 through a muffler cover-mounting portion 49 with the muffler 42 partially covered so as not to let a worker touch the muffler 42 with heat.

According to this structure, the following effects can be obtained.

(a) Since the mounting column 23 is provided on one lateral side (left or right) at the rear part of the upper frame 9, and the bonnet hinge 40 that serves as fulcrum on opening and closing bonnet 31 and the left panel 41 as the side panel are mounted on the mounting column 23, the mounting column 23 can be used also as the mounting and positioning member for the bonnet hinge 40 and the left panel 41. Therefore, the management of the space "c" (refer to FIG. 1) between the bonnet 31 and the left panel 41 is facilitated efficiently.

(b) Since the mounting column 23 is provided on one lateral side at the rear part of the upper frame 9, and the bonnet hinge 40 that serves as fulcrum on opening and closing bonnet 31 and the muffler cover 43 for covering the muffler 42 for engine exhaust in the vicinity of the bonnet 31 are mounted on the mounting column 23, the mounting column 23 can be used also as the mounting and positioning member for the bonnet hinge 40 and the muffler cover 43. Therefore, the management of the space between the bonnet 31 and the muffler cover 43 is facilitated efficiently.

Further, it is more preferable to take a structure adapting both the radiator support 22 as radiator mounting member and the mounting column 23, or provide the radiator support 22 for mounting the radiator 24 on one lateral side (eft or right) at the rear part of the upper frame 9 and the mounting column 23 on the opposite side (the other side).

On the other hand, the right end part and left end part of the seat stand 33 are mounted on the radiator support 22 and the mounting column 23, respectively, whereby a gate-shaped mount base "B" (refer to FIG. 2) is constituted by the three. Consequently, since the mount base B constituted by mounting the seat stand 33 between the radiator support 22 and the mounting column 23 is used also as a positioning support for a plurality of elements or members, and a plurality of members is collectively mounted on the mount base "B", the position management between the members to be mounted is facilitated efficiently.

In connection with this mount base "B", the seat stand 33 extends from the radiator support 22 to the mounting column 23 in such a manner of consisting the mount base B, and a plurality of members to be set on the upper frame 9 is mounted on the mount base B with the mount base B used also as the positioning support between members.

Since the right radiator support 22 and the left mounting column 23 are mutually reinforced and enhanced in rigidity by the connection through the seat stand 33, the mount base B is rich in strength and rigidity. Therefore, each member can be firmly and stably mounted in spite of the structure of collectively mounting each member.

In this case, the bonnet hinge 40 and the bonnet catch 32 are mounted on the mounting column 23 and the radiator support 22, respectively. Therefore, the position (space) management between the hinge 40 of the bonnet 31 and the catch 32 as the engaging member is facilitated effectively.

In the above embodiment, the radiator support 22 is arranged on the right side, and the mounting column 23 on the left side. However, the both may be laterally reversed. In this case, the equipment arrangement and structure described above may be reversed also according to it.

The present invention is suitable to a hydraulic excavator, particularly, a compact excavator which is highly desired for reduction in number of part items for mounting members from the point of the limitation of space. However, the present invention is also applicable to an excavating machine, a groove excavating machine and other working machines, which are constituted with an excavator as a base body, without being limited to this kind of excavators.

Although the invention has been described with reference to the preferred embodiments in the attached figures, it is noted that equivalents may be employed and substitutions made herein without departing from the scope of the invention as recited in the claims.

I claim:

1. A working machine comprising:

a lower traveling body;

an upper rotating body rotatably mounted on said lower traveling body, the upper rotating body having an upper frame, an engine and a radiator;

a guard cover pivotally provided to cover at least said radiator;

a radiator duct extending between said radiator and said guard cover so as to guide cooling air passing said guard cover to said radiator; and a radiator support provided on the upper frame, wherein said radiator duct and said guard cover are mounted to said upper rotating body via said radiator support.

2. A working machine comprising:

a lower traveling body;

an upper rotating body rotatably mounted on said lower traveling body, the upper rotating body having an upper frame and an engine including a muffler;

a bonnet pivotally provided to cover at least said engine;

a side panel arranged on one lateral side at the rear part of an openable hood for covering the back side of said engine; and a mounting column provided on said upper frame, wherein said bonnet and said side panel are mounted to said upper rotating body via said mounting column.

3. The working machine according to claim 2, further comprising a radiator provided on the upper rotating body and a radiator support provided on the upper frame, the radiator support provided on one lateral side at a rear part of the upper frame and the mounting column on a lateral side of the rear part of the upper frame opposite the radiator support, and a seat stand mounted to the radiator support and to the mounting column, wherein the seat stand extends between the radiator support and to the mounting column.

4. The working machine according to claim 1, further comprising a an oil tank and a seat stand, wherein the oil tank and the seat stand are all mounted to said upper rotating body via said radiator support.

5. The working machine according to claim 2, further comprising a bonnet pivotally provided to cover at least said engine, a muffler cover covered by said bonnet and provided to cover said muffler, and a mounting column provided on said upper frame, wherein said bonnet and said muffler cover are mounted to said upper rotating body via said mounting column.

6. The working machine according to claim 2, further comprising a seat stand mounted to said upper rotating body via said mounting column, and a fixed cover panel mounted to said upper rotating body via said mounting column.

7. The working machine according to claim 2, further comprising a radiator support mounted to said upper rotating body at a side of said engine opposite said mounting column.

8. The working machine according to claim 7, further comprising a radiator, a guard cover pivotally provided to cover at least said radiator, and a radiator duct extending between said radiator and said guard cover so as to guide cooling air passing said guard cover to said radiator, wherein said radiator, said radiator duct and said guard cover are all mounted to said upper rotating body via said radiator support.

9. The working machine according to claim 8, wherein said seat stand and said bonnet are also mounted to said radiator support.

10. A working machine comprising:

a lower traveling body;

an upper rotating body rotatably mounted on said lower traveling body, the upper rotating body having an upper frame, an engine and a radiator;

a guard cover pivotally provided to cover at least said radiator;

a canopy support mounted to said radiator support and passing through an opening in said guard cover; and a radiator support provided on the upper frame, wherein said canopy support and said guard cover are mounted to said upper rotating body via said radiator support.

11. A working machine comprising:

a lower traveling body;

an upper rotating body rotatably mounted on said lower traveling body, the upper rotating body having an upper frame and an engine including a muffler;

a bonnet pivotally provided to cover at least said engine;

a muffler cover covered by said bonnet and provided to cover said muffler; and a mounting column provided on said upper frame, wherein said bonnet and said muffler cover are mounted to said upper rotating body via said mounting column.

* * * * *